US006247447B1

(12) United States Patent
Muraji

(10) Patent No.: US 6,247,447 B1
(45) Date of Patent: Jun. 19, 2001

(54) THROTTLE VALVE CONTROLLER FOR INTERNAL COMBUSTION ENGINE

(75) Inventor: Tetsuo Muraji, Odawara (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 09/461,049

(22) Filed: Dec. 15, 1999

(30) Foreign Application Priority Data

Feb. 24, 1999 (JP) ..... 11-046140

(51) Int. Cl.[7] ..... F02D 9/02

(52) U.S. Cl. ..... 123/399; 123/361; 123/339.14; 251/129.01

(58) Field of Search ..... 123/339.14, 339.15, 123/399, 361, 400, 396; 251/129.01, 129.11

(56) References Cited

U.S. PATENT DOCUMENTS 4,976,237 * 12/1990 Bollinger ..... 251/129.11
5,490,487 * 2/1996 Kato et al. ..... 123/399
5,517,966 * 5/1996 Kanazawa et al. ..... 123/399
5,624,100 * 4/1997 Bolte et al. ..... 251/129.01

FOREIGN PATENT DOCUMENTS 2000-240474 * 5/2000 (JP) .

* cited by examiner

*Primary Examiner*—Henry C. Yuen
*Assistant Examiner*—Hiew T. Vo
(74) *Attorney, Agent, or Firm*—Kanesaka & Takeuchi

(57) ABSTRACT

To actuate a throttle valve, a first driving device is provided to drive the throttle valve only in a small throttle opening range, and a second driving device is provided to drive the throttle valve in a throttle opening range other than the small throttle opening range against a spring by using a throttle wire. The first driving device has a rotor and a magnetomotive force source. A magnet is provided on the rotor. Three pole pieces are provided on a peripheral edge facing the rotor. Pole pieces opposite to each other in polarity produced by the magnetomotive force source are connected by connecting magnetic paths.

3 Claims, 6 Drawing Sheets

THROTTLE VALVE CONTROLLER FOR INTERNAL COMBUSTION ENGINE

BACKGROUND OF THE INVENTION

1. Field of the Invention

The present invention relates to a throttle valve controller and, more particularly, to a throttle valve controller for an internal combustion engine that is used to finely control the intake air quantity when the internal combustion engine is in an idling state.

2. Description of the Prior Art

When an internal combustion engine for an automobile is in an idling state in particular, the intake air quantity is affected considerably by environmental or equipment temperature or other conditions. Therefore, it is necessary to finely control the intake air quantity. Various techniques of finely controlling the intake air quantity have already been proposed.

Examples of the proposed techniques are as follows:

① Japanese Patent Application Post-Examination Publication No. 5-34518 is an example of a bypass air valve system that controls a bypass air passage provided in parallel to the throttle valve. The publication discloses a system that uses a rotary solenoid valve.

② Japanese Patent Application Unexamined Publication (KOKAI) No. 3-107544 is an example of a direct-acting system that directly drives the throttle valve only in a small throttle opening range. The publication discloses a system in which the throttle valve is driven by a DC motor.

③ Japanese Patent Application No. 10-69410 is an example of a DBW (Drive By Wire) system in which the throttle valve is driven in the entire throttle opening range by using various actuators. Japanese Patent Application No. 10-69410 employs a torque motor as an actuator.

In the above-described various systems, the bypass air valve system stated in ① generally adopts open-loop control and hence suffers from problems in terms of accuracy. To adopt closed-loop control, a position sensor is additionally needed, resulting in an increase in cost.

The direct-acting system stated in ② drives the throttle valve by a DC motor and therefore requires speed reduction through a gear mechanism to obtain appropriate control resolution owing to the transmission structure thereof. Accordingly, this system suffers from problems in terms of response due to speed reduction as well as an increase in cost.

In the DBW system stated in ①, no matter which actuator is used, i.e. a torque motor, a DC motor, or a stepper motor, the cost of the actuator unavoidably increases to obtain satisfactory driving force and driving range. In addition, higher levels of fail-safe and limp-home capabilities are demanded. Accordingly, the system becomes unfavorably costly.

SUMMARY OF THE INVENTION

In view of the above-described problems associated with the prior art, an object of the present invention is to provide a throttle valve controller for an internal combustion engine that exhibits superior control resolution with a simple structure and is free from runaway due to a circuit failure and obtainable at reduced cost.

DETAILED DESCRIPTION OF THE EMBODIMENTS

Figure 1:
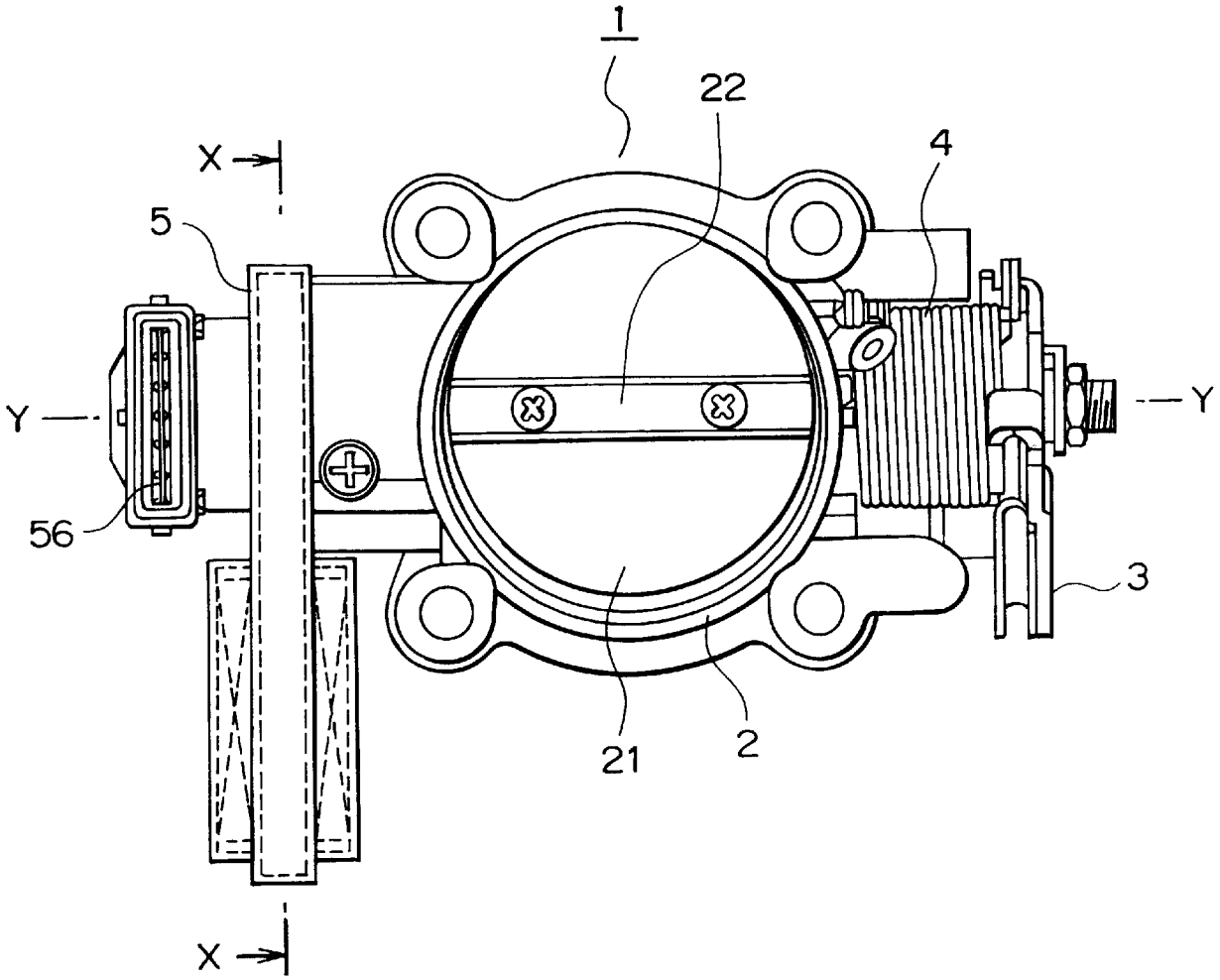
FIG. 1 is a plan view showing an embodiment of a throttle valve controller for an internal combustion engine according to the present invention.
Figure 2:
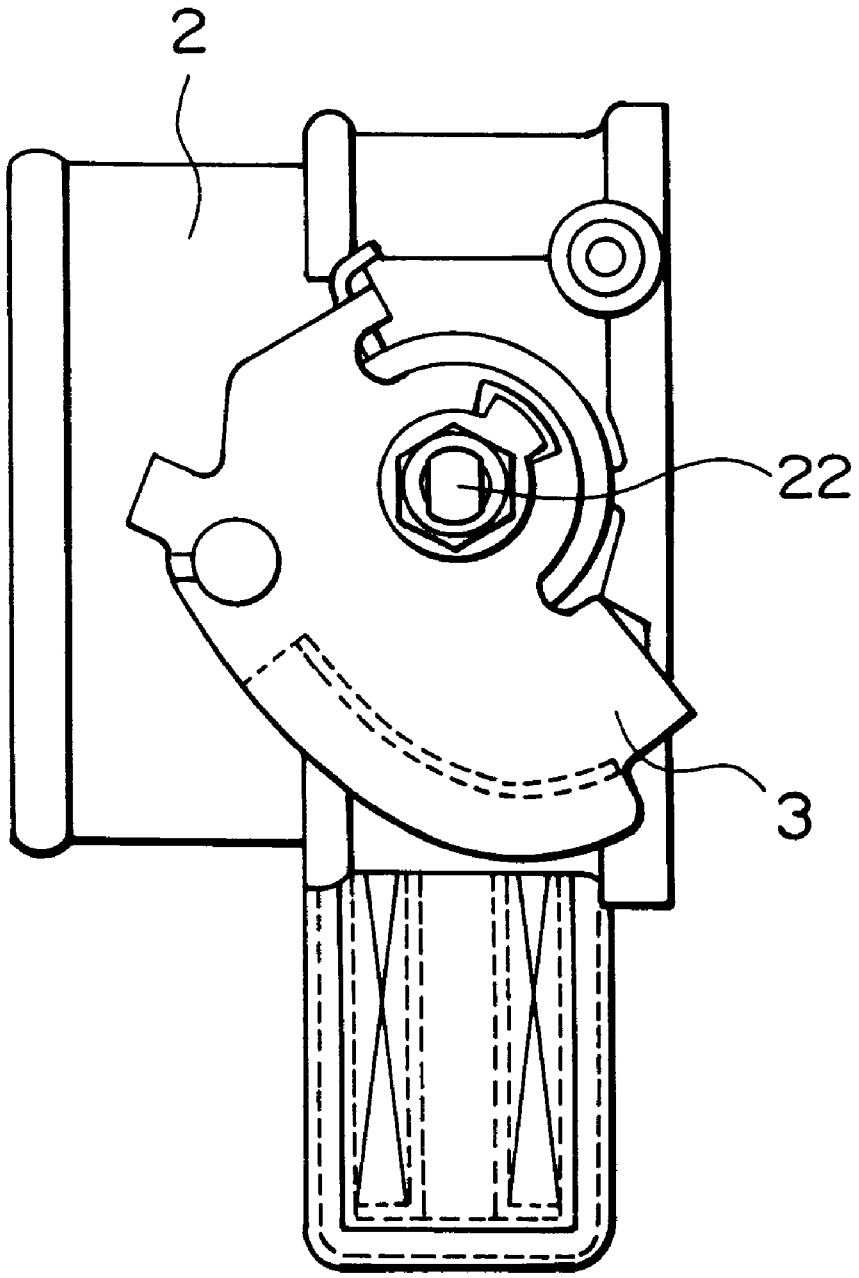
FIG. 2 is a side view of the embodiment as viewed from the right-hand side in FIG. 1.
Figure 3A:
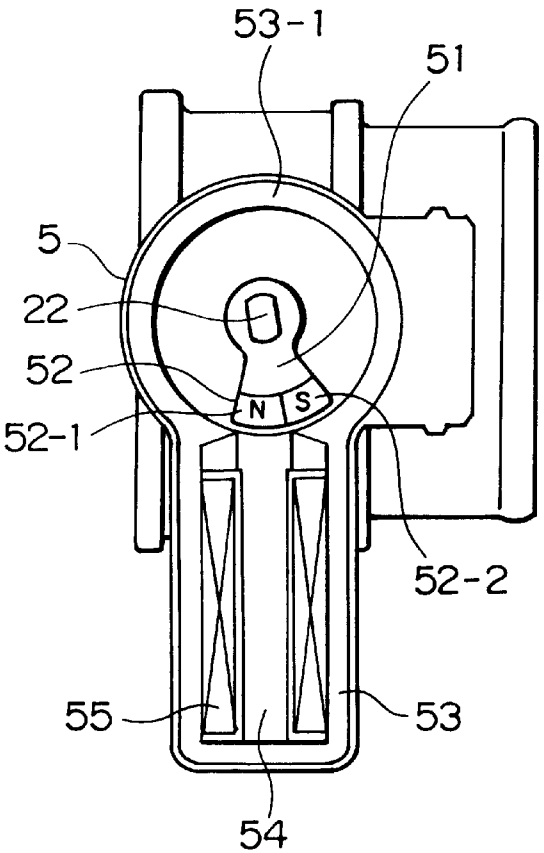
FIG. 3 is a sectional view taken along the line X—X in FIG. 1.
Figure 3B:
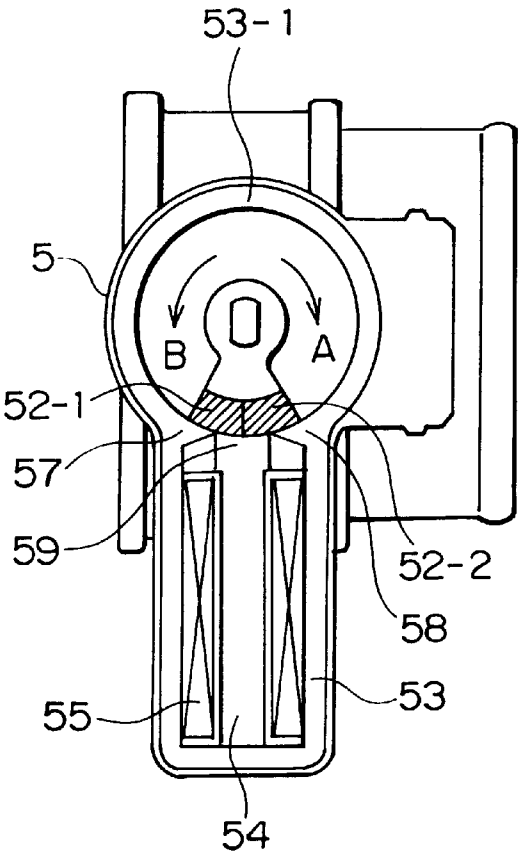
Figure 3C:
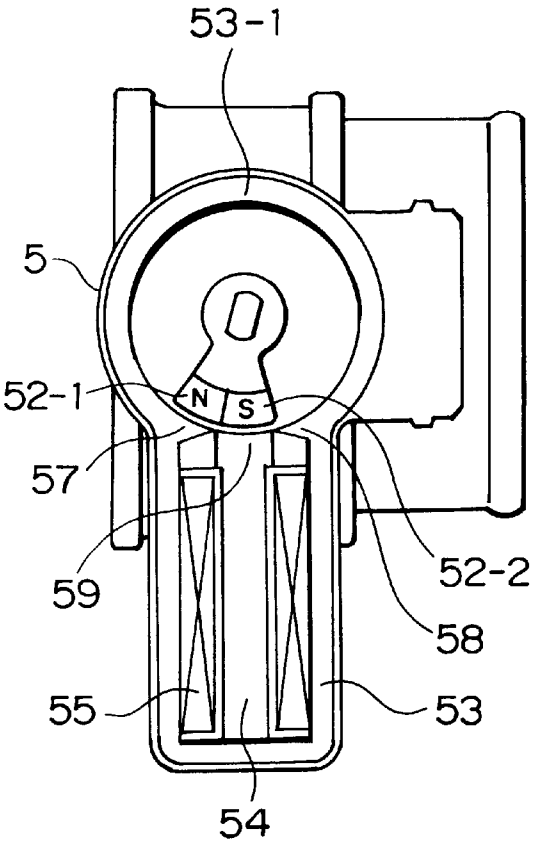
Figure 4:
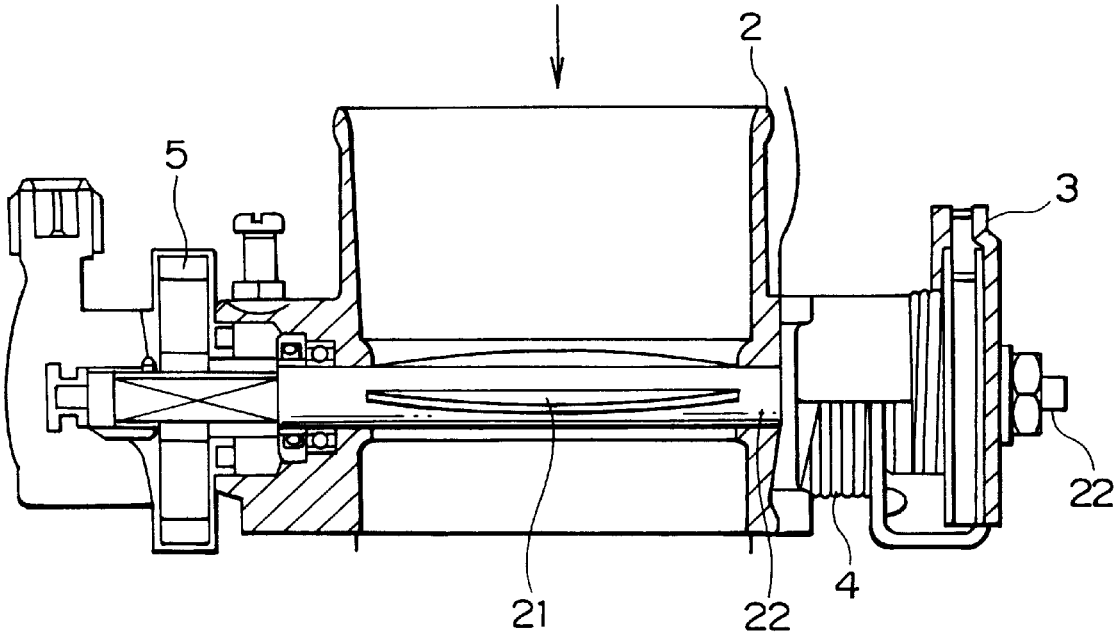
FIG. 4 is a fragmentary sectional view taken along the line Y—Y in FIG. 1.

FIG. 1 is a plan view showing the general structure of an embodiment of a throttle valve controller according to the present invention. Referring to FIG. 1, a throttle valve body 1 has an intake pipe 2. A throttle valve 21 is provided in the intake pipe 2. A shaft 22 extends through the throttle valve 21. The throttle valve 21 opens or closes the passage in the intake pipe 2 in response to the rotation of the shaft 22. FIG. 2 is a side view of the throttle valve controller as viewed from the right-hand side thereof. FIG. 3 is a sectional view taken along the line X—X in FIG. 1. FIG. 4 is a sectional view taken along the line Y—Y in FIG. 1, showing the central portion of the throttle valve controller. The embodiment will be described below with reference to these figures.

First, as shown in FIG. 1, a throttle lever 3 is engaged with the right-hand end of the shaft 22 as viewed in FIG. 1. The throttle lever 3 causes the shaft 22 to rotate against a return spring 4 by an operating force applied through a throttle wire (not shown) and thus opens or closes the throttle valve 21. It should be noted that when the engine is at rest, the throttle valve 21 is placed in substantially a fully-closed position by a return spring incorporated in a TPS (Throttle Position Sensor) 56. This will be described later in detail.

A torque motor 5 is provided on the left-hand end of the shaft 22. As shown in FIG. 3, a rotor 51 in the center of the torque motor 5 is integrally secured to the shaft 22. A permanent magnet 52 is mounted on the peripheral edge of the rotor 51. A yoke 53 has a circular portion 53-1 centered at the shaft 22. The circular portion 53-1 is integrally formed with the yoke 53 to form a connecting magnetic path. A core 54 is wound with a coil 55 as a magnetomotive force source. Reference numeral 56 denotes a connector.

Figure 5A:
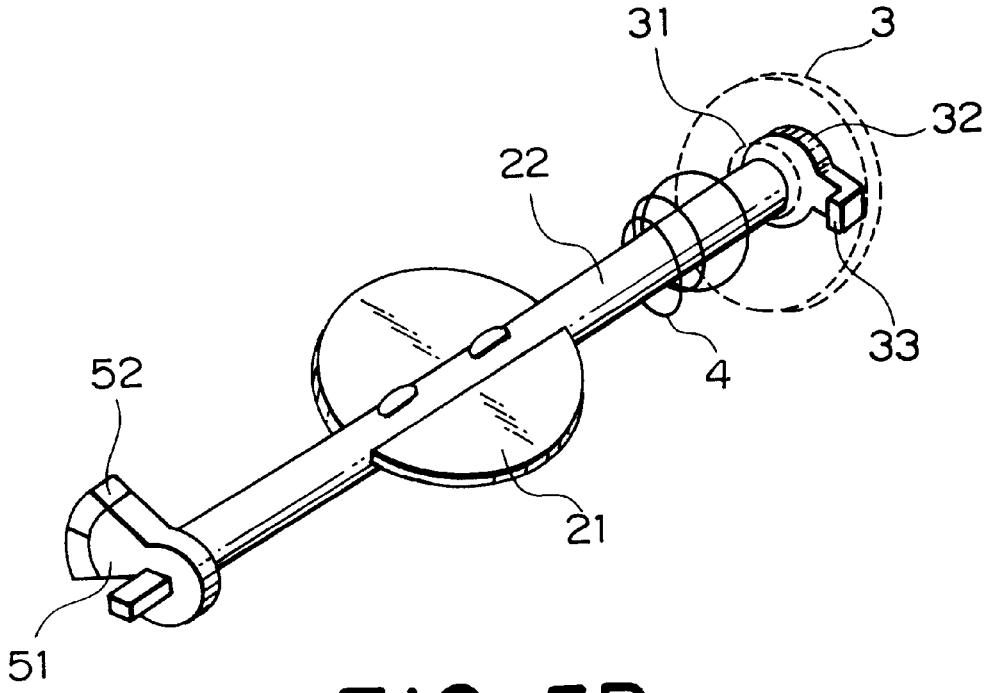
FIG. 5 is a diagram showing a linkage between a throttle valve and a throttle lever.
Figure 5B:
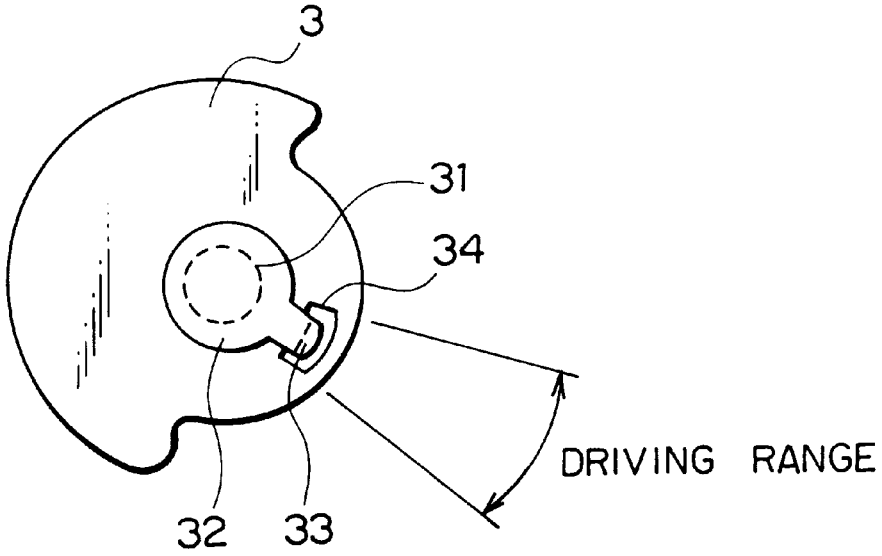

FIG. 5 is a diagram showing a linkage between the throttle valve 21 and the throttle lever 3. The link structure will be described below with reference to FIG. 5. As has already been stated above, the shaft 22 is connected to the throttle valve 21. The rotor 51, which has the permanent magnet 52 mounted on the peripheral edge thereof, is provided on one end of the shaft 22. The throttle lever 3 is engaged with the other end of the shaft 22.

First, the way in which the throttle valve 21 is driven by the throttle lever (herein referred to as "second driving device") 3 will be described below. Part (b) of FIG. 5 shows the way in which the throttle lever 3 and the shaft 22 are engaged with each other. The shaft 22 is not secured to the throttle lever 3 but rotatably inserted in a hole 31 provided in the throttle lever 3.

An actuator lever 32 is secured to a portion (end portion) of the shaft 22 projecting from the other side of the throttle lever 3. The actuator lever 32 has a bent portion 33 at the distal end thereof. The throttle lever 3 is provided with a cut portion 34. The bent portion 33 of the actuator lever 32 is engaged in the cut portion 34. Accordingly, when the throttle lever 3 is rotated by a throttle wire (not shown), the throttle valve 21 is opened or closed through the bent portion 33.

Next, the way in which the throttle valve 21 is driven by the torque motor (herein referred to as "first driving device") 5. In an idling state, an accelerator lever (not shown) is in a stop position. Therefore, the throttle lever 3 does not rotate but remains at rest. In this state, the throttle valve 21 is opened or closed by the torque motor 5, which is the first driving device, within the range defined by the cut portion 34 in the throttle lever 3. The torque motor 5 is controlled by an ECU (not shown) in conformity to the warming-up condition and electrical loading of the internal combustion engine, the outside air temperature, etc.

Next, the operation of the torque motor 5 will be described in detail with reference to FIG. 3. In the foregoing description, reference numeral 52 denotes merely a permanent magnet (hereinafter referred to as "magnet"). In the following description, the permanent magnet 52 is assumed to be a magnet having a north pole 52-1 magnetized at the left-hand end thereof and a south pole 52-2 at the right-hand end thereof, for example. It should be noted that part (a) of FIG. 3 is a diagram for describing the arrangement of the torque motor 5, and parts (b) and (c) of FIG. 3 are diagrams for describing the operation of the torque motor 5.

In part (b) of FIG. 3, when the coil 55 is energized so that a pole piece 59 becomes a south pole, pole pieces 57 and 58 that are provided on both sides of the pole piece 59 become north poles. At this time, attracting force acts between the south pole of the pole piece 59 and the north pole of the magnet 52-1. Attracting force also acts between the north pole of the pole piece 58 and the south pole of the magnet 52-2. Repelling force acts between the north pole of the pole piece 57 and the north pole of the magnet 52-1. Consequently, the shaft 22 rotates in the direction B.

Conversely, when the coil 55 is energized so that the pole piece 59 becomes a north pole, the shaft 22 rotates in the direction A in opposite relation to the above. Accordingly, the throttle valve 21 can be opened or closed by the torque motor 5 in the range of from the opening position shown in part (a) of FIG. 3 to the opening position shown in part (c) of FIG. 3. It should be noted that when the throttle opening is increased in excess of the opening position in part (c) of FIG. 3 [i.e. when the shaft 22 is further rotated in the direction A from the position in part (c) of FIG. 3] by the throttle wire, there is no or not enough portion of the magnet that faces opposite to the pole piece 59, and the throttle valve 21 comes out of the control range of the torque motor 5. Then, the throttle valve 21 is united with the throttle lever 3 and opened or closed only by the throttle wire. In this case, the torque motor 5 offers no resistance. Therefore, there is no undesired load imposed on the throttle wire.

This embodiment has the advantage that magnetic saturation is unlikely to occur. This will be described below. In general, magnetic flux produced in an actuator comprising a magnet and a coil passes through a magnetic path from the north pole of the magnet to the south pole of the magnet. At this time, the amount of magnetic flux passing through the magnetic path depends on the position of the rotor 51 and the coil current. Moreover, in order to ensure a necessary torque when the amount of magnetic flux is the largest, it is necessary to ensure a sufficiently large sectional area of the magnetic path to avoid influence of magnetic saturation.

The position shown in part (a) or (c) of FIG. 3 is where the largest magnetic flux is produced. Referring to part (c) of FIG. 3, the magnetic flux coming out of the magnet 52-1 is distributed to two magnetic paths, i.e. one magnetic path in which the magnetic flux from the magnet 52-1 passes through the pole piece 57 and enters the magnet 52-2 via the yoke 53, which is a connecting magnetic path, and the pole piece 59, and another magnetic path in which the magnetic flux from the magnet 52-1 passes through the pole piece 57 and enters the magnet 52-2 via the connecting magnetic path 53-1, the connecting magnetic path 53 and the pole piece 59. Therefore, magnetic saturation is unlikely to occur.

Supposing that there is no connecting magnetic path 53-1, all the magnetic flux from the magnet 52-1 passes through the pole piece 57 and enters the magnet 52-2 via the connecting magnetic path 53. Accordingly, the connecting magnetic path 53 needs a magnetic path having a sectional area approximately twice as large as the sectional area in a case where the connecting magnetic path 53-1 is provided. However, the present invention is not necessarily limited to this embodiment. If use conditions are set such that magnetic saturation will not occur, it is not always necessary to provide the circular portion 53-1, which forms a connecting magnetic path.

According to this embodiment, the actuator directly controls the throttle valve in a small throttle opening range. Therefore, a complicated arrangement such as a bypass valve is not needed. Moreover, the valve control resolution is superior. In addition, a TPS signal, which is indispensable to the throttle valve body, can be used for position feedback. Therefore, the control accuracy can be increased without an increase in cost. Furthermore, because the driving range of the actuator is limited by a magnetic circuit, there is no likelihood of runaway due to a failure in the control circuit.

Figure 6:
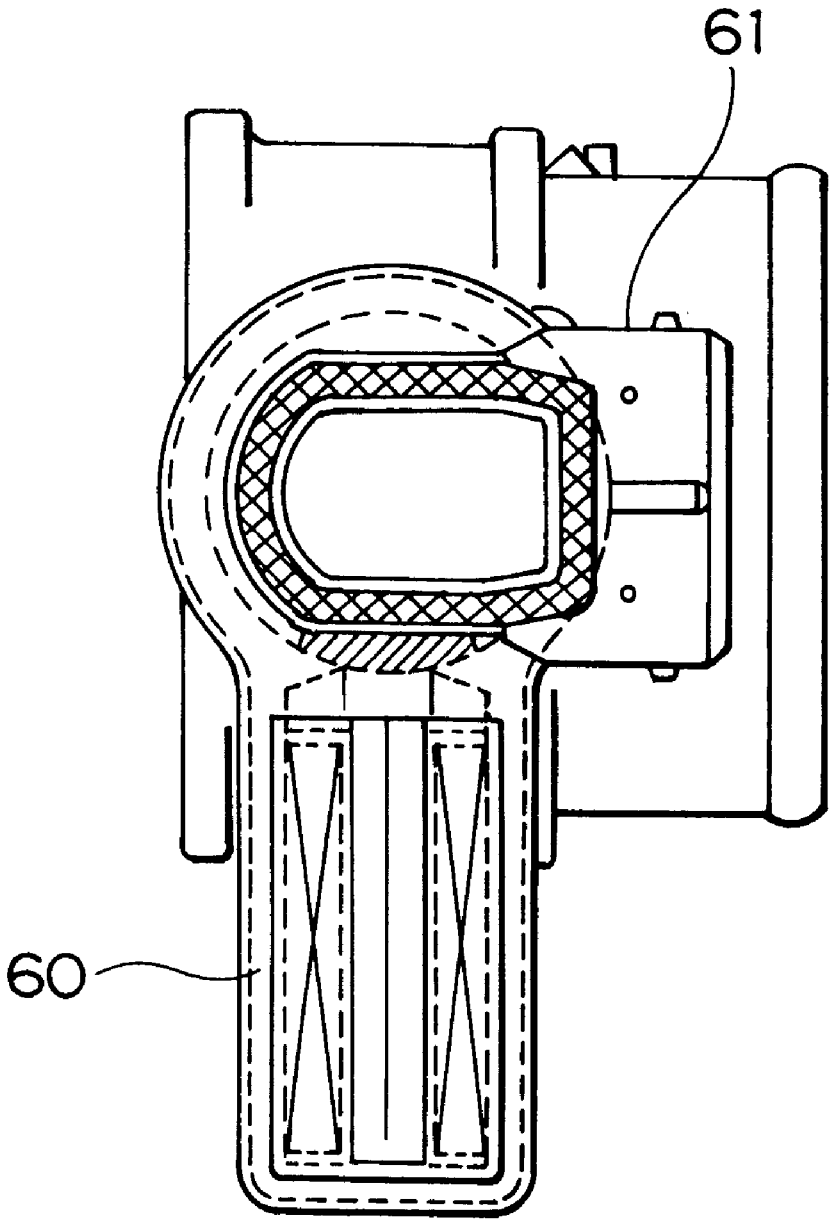
FIG. 6 is a diagram showing another embodiment of the present invention.

FIG. 6 shows another embodiment of the present invention. In FIG. 6, reference numeral 60 denotes a magnetic circuit body, and 61 denotes a TPS (Throttle Position Sensor) body. The magnetic circuit body 60, which has a coil, a core and a yoke molded when a magnetic circuit is formed, and the TPS body 61 are integrally formed. Therefore, one and the same connector can be used for input/output signals related to the TPS and an input o the coil. Accordingly, it is possible to reduce the cost and the number of man-hours needed for assembly.

As has been stated above, the present invention provides advantages as set forth in the following:

(1) Because the throttle valve is directly driven, no bypass valve is needed, and it is also unnecessary to provide a gear mechanism for transmitting driving force or a stopper mechanism.

(2) Because the driving range of the actuator is limited by a magnetic circuit, there is no likelihood of runaway due to a failure in the control circuit.

(3) Because the throttle valve is driven directly by the actuator without using a gear mechanism, the control resolution is superior.

(4) Because a TPS signal, which is indispensable to the throttle valve body, can be used for position feedback of the torque motor, the control accuracy can be increased without an increase in cost.

What is claimed is:

1. In a throttle valve controller for an internal combustion engine comprising first driving means for driving a throttle valve only in a predetermined throttle opening range, and second driving means for driving said throttle valve against a spring by using a throttle wire, the improvement wherein said first driving means is an electromagnetic actuator wherein a rotatable rotor and at least one magnetomotive force source are integrally incorporated through a magnetic path, said rotor being provided on a peripheral edge thereof with an integral magnet magnetized with a north pole and a south pole or separate magnets magnetized in opposite directions to have a north pole and a south pole, respectively, wherein three pole pieces are provided on a peripheral edge of an opening in which said rotor is provided, and two connecting magnetic paths are provided to connect pole pieces opposite to each other in polarity produced by said at least one magnetomotive force source, and said second driving means limits said predetermined throttle opening range, in which said throttle valve is driven by said first driving means, to a small throttle opening range in which idle speed control can be effected.

2. A throttle valve controller for an internal combustion engine according to claim 1, wherein a connecting magnetic path is provided to connect two pole pieces equal to each other in polarity produced by said magnetomotive force source.

3. A throttle valve controller for an internal combustion engine according to claim 1, wherein when molding is carried out to form a magnetic circuit of said first driving means, a body of a throttle position sensor is integrally formed with said magnetic circuit, and one connector is used for both an input/output signal related to said throttle position sensor and an input to said magnetomotive force source.

* * * * *